US008777360B2

(12) United States Patent
Munakata

(10) Patent No.: US 8,777,360 B2
(45) **Date of Patent: *Jul. 15, 2014**

(54) LIQUID EJECTING APPARATUS AND METHOD FOR CONTROLLING LIQUID EJECTING HEAD

(71) Applicant: Seiko Epson Corporation, Tokyo (JP)

(72) Inventor: Manabu Munakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/042,033

(22) Filed: Sep. 30, 2013

(65) Prior Publication Data

US 2014/0028762 A1 Jan. 30, 2014

Related U.S. Application Data

(63) Continuation of application No. 13/718,605, filed on Dec. 18, 2012, now Pat. No. 8,573,728, which is a continuation of application No. 13/006,292, filed on Jan. 13, 2011, now Pat. No. 8,348,375.

(30) Foreign Application Priority Data

Mar. 1, 2010 (JP) ..... 2010-043854

(51) Int. Cl.
*B41J 29/38* (2006.01)

(52) U.S. Cl.
USPC ..... 347/14; 347/5; 347/9

(58) Field of Classification Search
USPC ..... 347/14
See application file for complete search history.

(56) References Cited

U.S. PATENT DOCUMENTS

2005/0035985 A1 2/2005 Taguchi et al.

FOREIGN PATENT DOCUMENTS

| | | |
|---|---|---|
| JP | 2000-015837 | 1/2000 |
| JP | 2003-001842 | 1/2003 |
| JP | 2005-035103 | 2/2005 |
| JP | 2005-088568 | 4/2005 |
| JP | 2007-050581 | 3/2007 |

*Primary Examiner* — Uyen Chau N Le
*Assistant Examiner* — Kajli Prince
(74) *Attorney, Agent, or Firm* — Workman Nydegger

(57) ABSTRACT

One of the two flow passages branches from one of two ink cartridges to one of the two discharging portions and one of the two individual discharging portions. The other flow passage branches from the other ink cartridge to the other discharging portion and the other individual discharging portion. A ratio of frequency of use of each of the discharging portions, Ra, and frequency of use of each of the individual discharging portions, Rb, satisfies Ra:Rb=1:1/2.

16 Claims, 6 Drawing Sheets

LIQUID EJECTING APPARATUS AND METHOD FOR CONTROLLING LIQUID EJECTING HEAD

This application is a Continuation of U.S. patent application Ser. No. 13/718,605 filed Dec. 18, 2012 (which is expressly incorporated by reference herein in its entirety), which is a Continuation of U.S. patent application Ser. No. 13/006,292 filed Jan. 13, 2011 (which is also expressly incorporated by reference herein in its entirety), which claims the benefit of Japanese Patent Application No. 2010-043854, filed Mar. 1, 2010 (which is also expressly incorporated herein by reference in its entirety).

BACKGROUND

1. Technical Field

The present invention relates to a liquid ejecting apparatus that ejects liquid from nozzles and a method for controlling a liquid ejecting head.

2. Related Art

An ink-jet printer is known as an example of a liquid ejecting apparatus that ejects liquid onto a target in the form of droplets. The ink-jet printer prints an image or the like on paper by discharging ink droplets onto the paper. Such a printer moves a recording head in the main scan direction and paper in the sub scan direction. Mounted on a carriage, the recording head and ink cartridges reciprocate. Lines of nozzles are formed in the bottom surface of the recording head. The ink cartridge is in communication with the nozzle line through a flow passage. Ink flows from the ink cartridge to the nozzle line through the flow passage. In the field of such a recording head, JP-A-2007-50581 discloses the following technique. A flow passage branches from one ink cartridge into a plurality of branch passages, which is connected to a plurality of nozzle lines. The positions of the nozzle lines are shifted in the sub scan direction. To make conditions such as pressure inside flow passages uniform, ink is sucked from the plurality of nozzle lines.

There is a demand for mounting a plurality of ink cartridges of the same color on a carriage and reducing the frequency of ink-cartridge replacement. However, if the above technique of providing a flow passage that branches from one ink cartridge for connection to a plurality of nozzle lines is applied to such an application in which a plurality of ink cartridges of the same color is mounted on a carriage, the proportion of the number of the ink cartridges to the number of the nozzle lines shifted in the sub scan direction is limited to an integral multiple, which means that there is little room for flexibility. In order to reduce the frequency of ink-cartridge replacement, it is necessary to ensure that the amount of ink contained in the plurality of ink cartridges of the same color should decrease at the same speed. However, if the proportion of the number of the ink cartridges to the number of the nozzle lines shifted in the sub scan direction is not limited to an integral multiple, it is impossible to consume ink contained in the plurality of ink cartridges equally.

SUMMARY

An advantage of some aspects of the invention is to provide a technique for consuming liquid contained in a plurality of liquid containers such as ink cartridges equally without limiting the proportion of the number of the liquid containers to the number of nozzle lines shifted in a first direction, which is the sub scan direction, to an integral multiple.

A liquid ejecting apparatus according to a first aspect of the invention ejects liquid supplied from two liquid containers that contain liquid of the same kind. The liquid ejecting apparatus includes two discharging portions, a group of discharging portions, two flow passages, and a controlling section. Each of the two discharging portions has a plurality of nozzles aligned in parallel with a first direction. The nozzles of one of the two discharging portions are located at positions in the first direction that are different from positions of the nozzles of the other discharging portion in the first direction. The group of discharging portions includes two individual discharging portions each of which has a plurality of nozzles. The nozzles of each of the two individual discharging portions are located at positions in the first direction that are different from the positions of the nozzles of the one of the two discharging portions in the first direction and from the positions of the nozzles of the other of the two discharging portions in the first direction. The nozzles of one of the two individual discharging portions are located at the same positions in the first direction as the nozzles of the other individual discharging portion. Each of the two flow passages is provided for the corresponding one of the two liquid containers. One of the two flow passages branches from one of the two liquid containers. The one liquid container is in communication with the one discharging portion and the one individual discharging portion through the one flow passage. The other flow passage branches from the other liquid container. The other liquid container is in communication with the other discharging portion and the other individual discharging portion through the other flow passage. Let the frequency of use of each of the two discharging portions be denoted as Ra. Let the frequency of use of each of the two individual discharging portions be denoted as Rb. The controlling section carries out control in such a manner that a ratio of Ra to Rb satisfies the following relation; Ra:Rb=1:1/2. In the first aspect of the invention, each of the two discharging portions discharges liquid by "1" per unit time, whereas each of the two individual discharging portions discharges liquid by "1/2" per unit time. Since the one liquid container is in communication with the one discharging portion and the one individual discharging portion through the one flow passage, which branches from the one liquid container, liquid flows out of the one liquid container by "1.5" per unit time. Since the other liquid container is in communication with the other discharging portion and the other individual discharging portion through the other flow passage, which branches from the other liquid container, liquid flows out of the other liquid container by "1.5" per unit time. Therefore, it is possible to make the speed of the decrease in the amount of liquid contained in the one liquid container equal to the speed of the decrease in the amount of liquid contained in the other liquid container. This makes it possible to replace the two liquid containers at the same time, thereby lightening the burden of a user. Generally, flushing operation in which a predetermined amount of liquid is discharged needs to be performed at the time of replacement of liquid containers. Since the number of times of replacement required is reduced, the amount of liquid consumed due to flushing can be reduced.

A liquid ejecting apparatus according to a second aspect of the invention ejects liquid supplied from a plurality of liquid containers that contains liquid of the same kind. The number of the liquid containers is denoted as P (where P is a natural number that is not less than 2). The liquid ejecting apparatus includes a plurality of discharging portions, a group of discharging portions, a plurality of flow passages, and a controlling section. The number of the discharging portions is denoted as P×J (where J is a natural number). Each of the P×J discharging portions has a plurality of nozzles aligned in parallel with a first direction. The nozzles of each of, or one of, the P×J discharging portions are located at positions in the first direction that are different from positions of the nozzles of the other discharging portions, or the other discharging portion, in the first direction. The group of discharging portions includes a plurality of individual discharging portions each of which has a plurality of nozzles. The number of the individual discharging portions is denoted as P×K (where K is a natural number). The nozzles of each of the P×K individual discharging portions are located at positions in the first direction that are different from the positions of the nozzles of all of the P×J discharging portions in the first direction. The nozzles of each of, or one of, the P×K individual discharging portions are located at the same positions in the first direction as the nozzles of the other individual discharging portions, or the other individual discharging portion. Each of the plurality of flow passages is provided for the corresponding one of the P liquid containers. Each of the P flow passages branches from the corresponding one of the P liquid containers in such a manner that the liquid container is in communication with at least one discharging portion, the number of which is denoted as J, and at least one individual discharging portion, the number of which is denoted as K, through the flow passage. A certain set of J discharging portions or a certain J discharging portion that is communicated through a certain flow passage is different from the other set thereof, the other sets thereof, the other, or the others that is/are communicated through the other flow passage or the other flow passages. A certain set of K individual discharging portions or a certain K individual discharging portion that is communicated through a certain flow passage is different from the other set thereof, the other sets thereof, the other, or the others that is/are communicated through the other flow passage or the other flow passages. Let the frequency of use of each of the P×J discharging portions be denoted as Ra. Let the frequency of use of each of the P×K individual discharging portions be denoted as Rb. The controlling section carries out control in such a manner that a ratio of Ra to Rb satisfies the following relation; Ra:Rb=1:1/(P×K).

In the second aspect of the invention, each of the P×J discharging portions discharges liquid by "1" per unit time, whereas each of the P×K individual discharging portions discharges liquid by "1/(P×K)" per unit time. Each of the P flow passages branches from the corresponding one of the P liquid containers in such a manner that the liquid container is in communication with the J discharging portion(s) and the K individual discharging portion(s) through the flow passage. Therefore, liquid flows out of the liquid container by "1+1/(P×K)" per unit time. That is, it is possible to equalize the speed of the decrease in the amount of liquid contained in each of the liquid containers. Since the nozzles of each of discharging segments, which are made up of the P×J discharging portions and the single group of discharging portions, are shifted from those of the others in the first direction, it is possible to discharge liquid onto a target object without leaving any non-discharged region by utilizing them equally. Since the nozzles of each of, or one of, the P×K individual discharging portions is located at the same positions in the first direction as the nozzles of the other individual discharging portions, or the other individual discharging portion, it is possible to use them while sequentially switching over from one individual discharging portion to another, or between the two. The frequency of use of each of the P×J discharging portions is equal to the frequency of use of the single group of discharging portions. If this frequency of use is expressed as "1", the frequency of use of each of the P×K individual discharging portions can be expressed as "1/(P×K)". This makes it possible to replace the P liquid containers at the same time, thereby lightening the burden of a user. As described above, generally, flushing operation in which a predetermined amount of liquid is discharged needs to be performed at the time of replacement of liquid containers. Since the number of times of replacement required is reduced, the amount of liquid consumed due to flushing can be reduced.

In the liquid ejecting apparatus according to the above aspect of the invention, it is preferable that the controlling section should switch the individual discharging portions for every unit time period for sequential use. For example, in a structure in which the group of discharging portions includes a first individual discharging portion, a second individual discharging portion, and a third individual discharging portion, they are used sequentially in the order of the first individual discharging portion→the second individual discharging portion→the third individual discharging portion→the first individual discharging portion→ . . . (omitted). In the liquid ejecting apparatus having the preferred structure described above, more preferably, the liquid should be ink; each of the discharging portions and the individual discharging portions should be used for discharging the ink onto paper; the unit time period should be a period of time for printing on a predetermined number of sheets of the paper; and the controlling section should switch the individual discharging portions for every unit time period determined by the predetermined number of sheets for sequential use. Alternatively, the unit time period may be a period of time for printing for a predetermined number of columns; and the controlling section may switch the individual discharging portions for every unit time period determined by the predetermined number of columns for sequential use. Alternatively, the unit time period may be a period of time for printing for a predetermined number of rows; and the controlling section may switch the individual discharging portions for every unit time period determined by the predetermined number of rows for sequential use. With such sequential switching from one individual discharging portion to another cyclically, or switching between the two individual discharging portions, frequency-of-use control can be simplified.

Another aspect of the present invention is a method for controlling a liquid ejecting head. The liquid ejecting head controlled by the method ejects liquid supplied from a plurality of liquid containers that contains liquid of the same kind. The number of the liquid containers is denoted as P (where P is a natural number that is not less than 2). The liquid ejecting head includes a plurality of discharging portions, a group of discharging portions, and a plurality of flow passages. The number of the discharging portions is denoted as P×J (where J is a natural number). Each of the P×J discharging portions has a plurality of nozzles aligned in parallel with a first direction. The nozzles of each of, or one of, the P×J discharging portions are located at positions in the first direction that are different from positions of the nozzles of the other discharging portions, or the other discharging portion, in the first direction. The group of discharging portions includes a plurality of individual discharging portions each of which has a plurality of nozzles. The number of the individual discharging portions is denoted as P×K (where K is a natural number). The nozzles of each of the P×K individual discharging portions are located at positions in the first direction that are different from the positions of the nozzles of all of the P×J discharging portions in the first direction. The nozzles of each of, or one of, the P×K individual discharging portions are located at the same positions in the first direction as the nozzles of the other individual discharging portions, or the other individual discharging portion. Each of the plurality of flow passages is provided for the corresponding one of the P liquid containers. Each of the P flow passages branches from the corresponding one of the P liquid containers in such a manner that the liquid container is in communication with at least one discharging portion, the number of which is denoted as J, and at least one individual discharging portion, the number of which is denoted as K, through the flow passage. A certain set of J discharging portions or a certain J discharging portion that is communicated through a certain flow passage is different from the other set thereof, the other sets thereof, the other, or the others that is/are communicated through the other flow passage or the other flow passages. A certain set of K individual discharging portions or a certain K individual discharging portion that is communicated through a certain flow passage is different from the other set thereof, the other sets thereof, the other, or the others that is/are communicated through the other flow passage or the other flow passages. Let the frequency of use of each of the P×J discharging portions be denoted as Ra. Let the frequency of use of each of the P×K individual discharging portions be denoted as Rb. The controlling method is characterized by carrying out control in such a manner that a ratio of Ra to Rb satisfies the following relation; Ra:Rb=1:1/(P×K).

BRIEF DESCRIPTION OF THE DRAWINGS

The invention will be described with reference to the accompanying drawings, wherein like numbers reference like elements.

DESCRIPTION OF EXEMPLARY EMBODIMENTS

1. Embodiment

Figure 1:
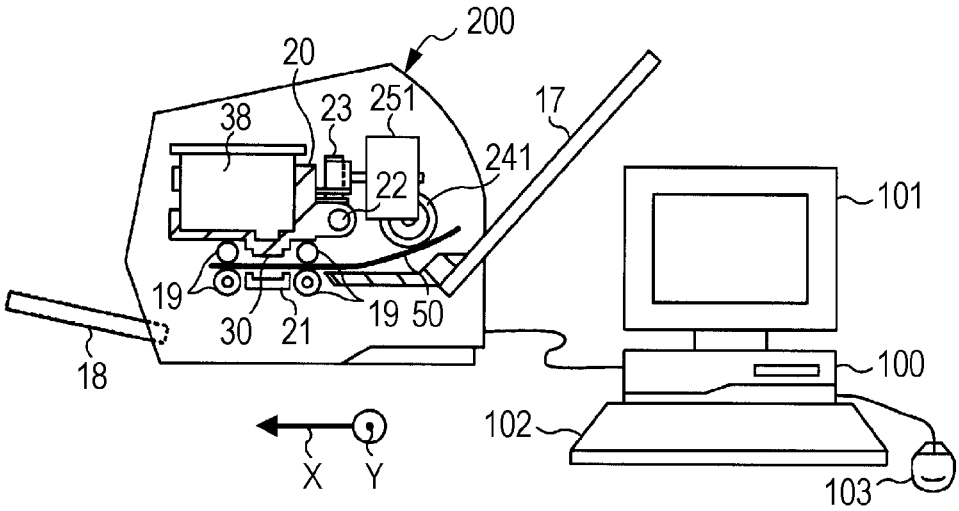
FIG. 1 is a diagram that schematically illustrates an example of the overall configuration of a printing system.

As illustrated in FIG. 1, a printing system, which is a liquid ejecting system according to the present embodiment of the invention, includes a computer 100 used by a user and an ink-jet color printer (hereinafter referred to as printer) 200 connected to the computer 100. The printer 200 is a liquid ejecting apparatus according to the present embodiment of the invention. The computer 100 includes a keyboard 102 and a mouse 103, which are operated for, for example, inputting characters or changing setting. The computer 100 is connected to a monitor 101. On the screen of the monitor 101, users designate a document that they want to be printed and give an instruction for print execution.

The printer 200 includes a paper-feed tray 17 and a paper-eject tray 18, each of which is provided outside its printer body, and a plurality of paper-transport rollers 19, which is provided inside the printer body. The paper-transport rollers 19 rotate when driven by a paper-transport motor 241. A medium 50, which is a target, is fed from the paper-feed tray 17 into the body of the printer 200. The paper-transport rollers 19 rotate to transport the medium 50 in the sub scan direction X inside the printer 200. The medium 50 is ejected to the paper-eject tray 18. A typical example of the medium 50 is plain paper. The medium 50 is, however, not limited thereto as long as it serves as the target of printing. Alternative examples of the medium 50 include but not limited to special glossy paper, special non-glossy paper, cloth, matte paper, and vinyl chloride.

The printer 200 includes a carriage 20 and a platen 21 inside the printer body. The platen 21 is disposed opposite the carriage 20. The platen 21 is a table that supports the medium 50 during printing. The paper-transport rollers 19 rotate to transport the medium 50 over the platen 21 during printing. The carriage 20 is movably fitted on a guiding shaft 22. The carriage 20 is fixed to a timing belt 23. The timing belt 23 turns when driven by a carriage motor 251. With such a structure, the carriage 20 can reciprocate in the main scan direction Y, which is the direction orthogonal to the sheet face of FIG. 1.

Figure 2:
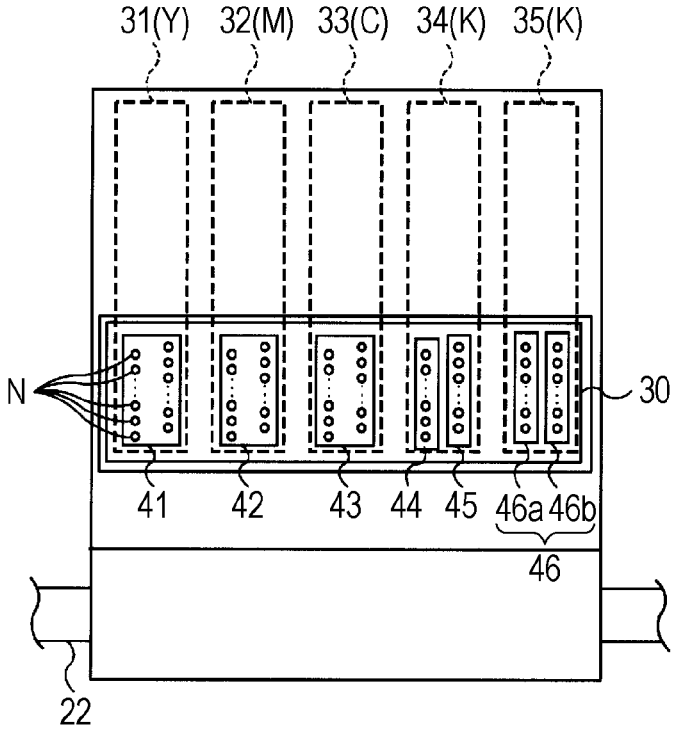
FIG. 2 is a bottom view of a recording head.

As illustrated in FIG. 1, a recording head 30 is provided on the bottom of the carriage 20. The recording head 30 is an example of a liquid ejecting head. As illustrated in FIG. 2, discharging portions 41, 42, 43, 44, and 45 and a group of discharging portions 46 are formed in the bottom surface of the recording head 30. Lines of nozzles are formed in each of the discharging portions 41, 42, 43 and the group of discharging portions 46. A line of nozzles is formed in each of the discharging portions 44 and 45. The nozzle line is made up of a plurality of aligned nozzles N. The recording head 30 ejects ink from the nozzle lines onto the medium 50 by utilizing the stretching and shrinking of piezoelectric elements 261 illustrated in FIG. 4. Therefore, while moving in the main scan direction Y, the carriage 20 ejects ink of each color from the recording head 30 provided on its bottom to perform printing on the medium 50.

As illustrated in FIG. 2, five ink cartridges 31, 32, 33, 34, and 35 having the same shape are mounted on the carriage 20. Each of the ink cartridges 31 to 35 is connected to two lines of nozzles N. The lines of nozzles N are located under these ink cartridges. Ink contained in the ink cartridges 31 to 35 is ejected to the outside from the nozzle lines formed in the discharging portions 41, 42, 43, 44, and 45 and the group of discharging portions 46 located under the ink cartridges 31 to 35.

Yellow (Y) ink is contained in the ink cartridge 31. Magenta (M) ink is contained in the ink cartridge 32. Cyan (C) ink is contained in the ink cartridge 33. Black (K) ink is contained in the ink cartridges 34 and 35. In other words, one ink cartridge is mounted on the carriage 20 for each of cyan, magenta, and yellow. Two black ink cartridges are mounted on the carriage 20. When in mint condition, the amount of black ink contained in the black ink cartridge 34 is the same as that of black ink contained in the black ink cartridge 35.

Figure 3:
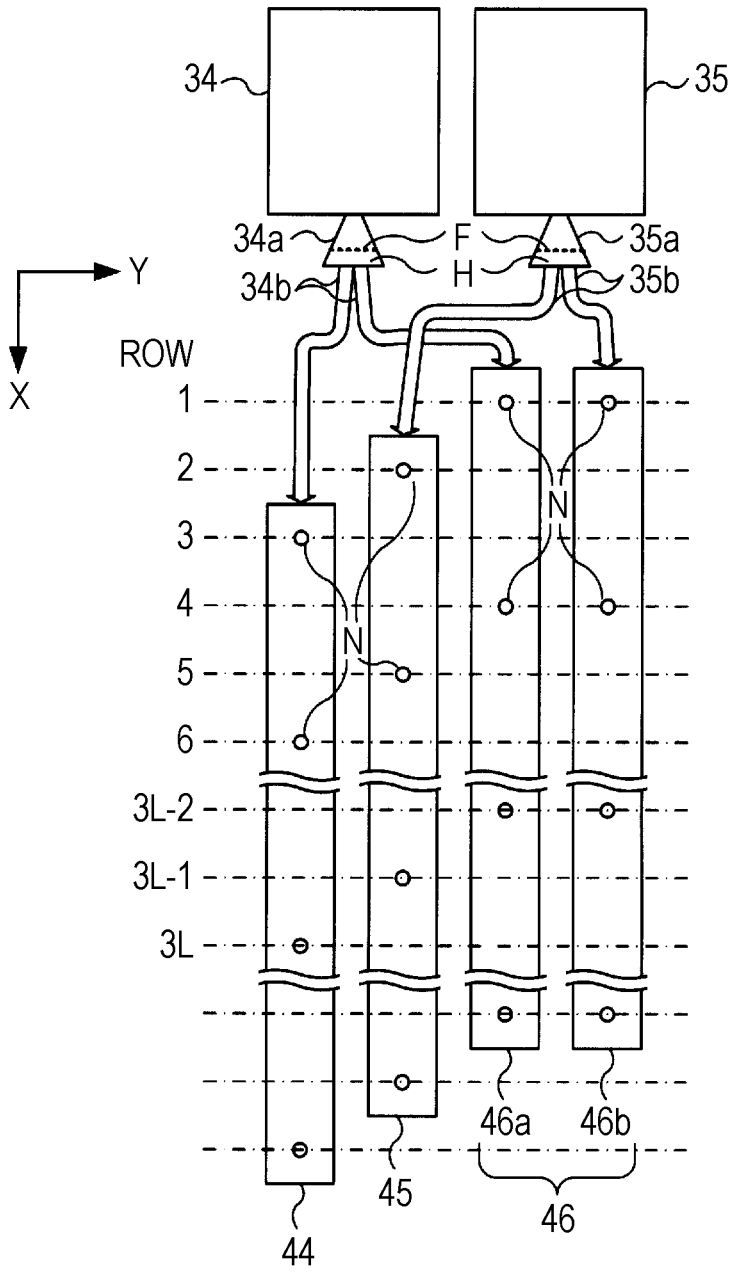
FIG. 3 is a diagram that schematically illustrates an example of a relationship between black ink cartridges, discharging portions, and individual discharging portions according to an exemplary embodiment of the invention.

FIG. 3 is a diagram that schematically illustrates an example of a relationship between the black (K) ink cartridges 34 and 35, discharging portions, and individual discharging portions according to an exemplary embodiment of the invention. A part of the bottom surface of each of the ink cartridges 34 and 35 is covered with a film. On the other hand, needles 34*a* and 35*a* are provided on the carriage 20. When the ink cartridges 34 and 35 are attached to the carriage 20, the needles 34*a* and 35*a* pierce through the films to be inserted into the ink cartridges 34 and 35, respectively. A through hole is formed at the tip of each of the needles 34*a* and 35*b*. Black ink can flow out through the hole of each of the needles 34*a* and 35*b* The other ink cartridges 31, 32, and 33 have the same structure as that of the black ink cartridges 34 and 35. Therefore, ink can flow out through their needle holes. A filter F for preventing the infiltration of any foreign object, air, and the like is provided as a partition at the base of each of the needles 34*a* and 35*a*. A flow passage 34*b*, which includes two branches (i.e., branch passages), is provided in communication with an ink chamber H for the black ink cartridge 34. A flow passage 35*b*, which also includes two branches, is provided in communication with an ink chamber H for the black ink cartridge 35.

A plurality of nozzles N is formed in each of the discharging portion 44, the discharging portion 45, and the group of discharging portions 46. The nozzles N are located on the 3L-th rows (where the suffix "-th" indicates that the numbers constitute a regular set of ordinal numbers; the term "rows" means lines going in the Y direction; the same applies hereinafter) in the nozzle line of the discharging portion 44. The nozzles N are located on the (3L−1)-th rows in the nozzle line of the discharging portion 45. The nozzles N are located on the (3L−2)-th rows in each of the nozzle lines of the group of discharging portions 46. Herein, the symbol L denotes natural numbers. As described above, the nozzles N of the discharging portion 44 are located at the positions in the sub scan direction X that are different from the positions of the nozzles N of the discharging portion 45 in the sub scan direction X; in addition, the nozzles N of the group of discharging portions 46 are located at the positions in the sub scan direction X that are different from the positions of the nozzles N of the discharging portion 44 in the sub scan direction X and from the positions of the nozzles N of the discharging portion 45 in the sub scan direction X. The group of discharging portions 46 is made up of two individual discharging portions 46*a* and 46*b*. The nozzles N of the individual discharging portion 46*a* are located at the same positions in the sub scan direction X as the nozzles N of the individual discharging portion 46*b*. The ink cartridge 34 is in communication with the discharging portion 44 through one of the branches of the flow passage 34*b*. The ink cartridge 34 is in communication with the individual discharging portion 46*a* through the other of the branches of the flow passage 34*b*. The ink cartridge 35 is in communication with the discharging portion 45 through one of the branches of the flow passage 35*b*. The ink cartridge 35 is in communication with the individual discharging portion 46*b* through the other of the branches of the flow passage 35*b*. In other words, in the present embodiment of the invention, the two black ink cartridges 34 and 35 are in communication with the discharging portion 44, the discharging portion 45, and the group of discharging portions 46, which are three types of discharging segments each of which has the nozzles N that are shifted from those of the others in the sub scan direction X, through the flow passages 34*b* and 35*b*. In each of the discharging portion 44, the discharging portion 45, the individual discharging portion 46*a*, and the individual discharging portion 46*b*, a pressure chamber is provided for each of the plurality of nozzles N. The aforementioned piezoelectric element 261 (refer to FIG. 4) is provided for each of the plurality of pressure chambers. As a result of the stretching and shrinking of the piezoelectric element 261, a change in the pressure of the pressure chamber occurs, which results in the discharging of an ink droplet from the nozzle N onto the medium 50.

Figure 4:
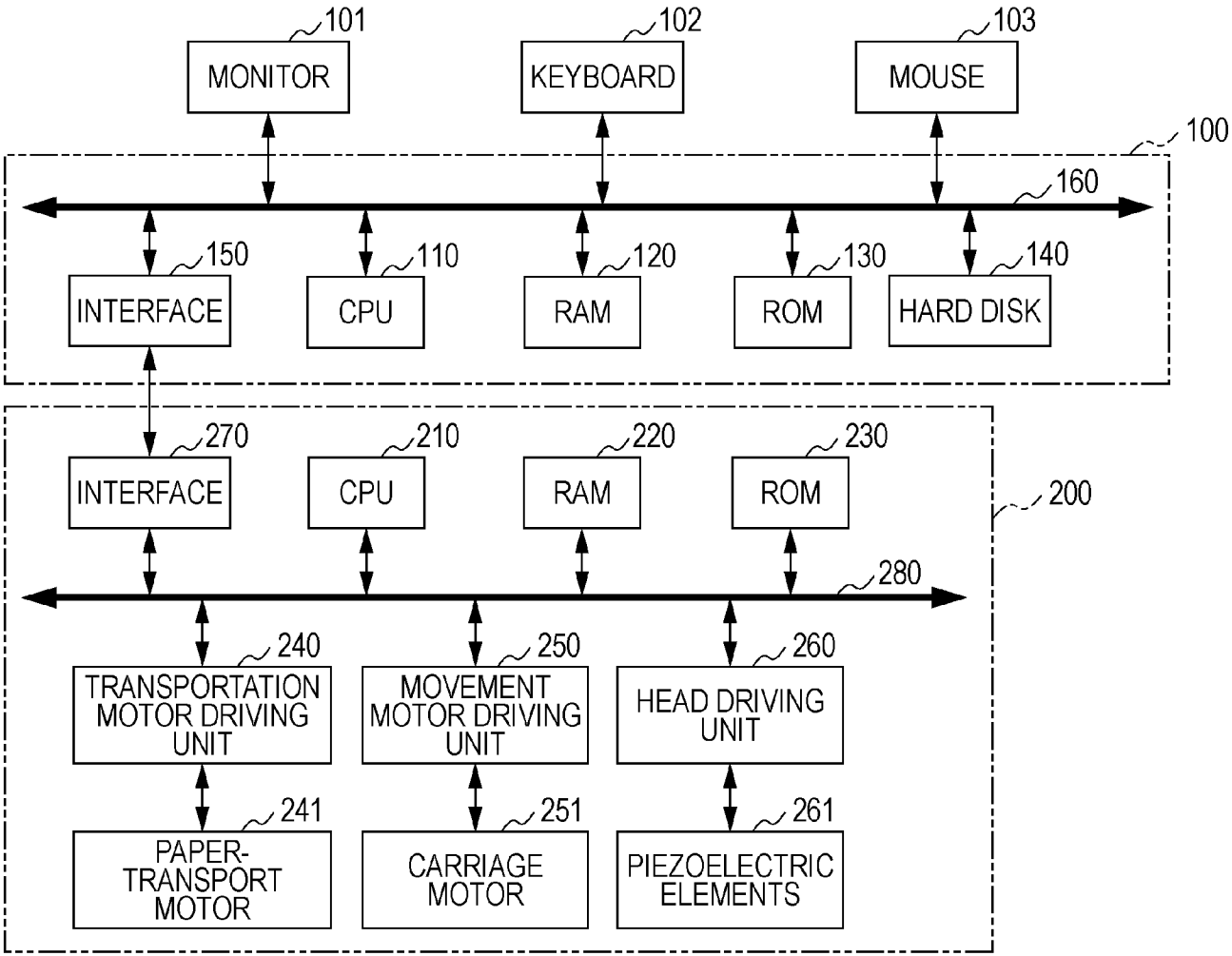
FIG. 4 is a block diagram that schematically illustrates an example of the electric configuration of the printing system.

Next, with reference to FIG. 4, the electric configuration of the above printing system will now be explained. The computer 100 includes a CPU 110. The CPU 110 is connected to the monitor 101, the keyboard 102, and the mouse 103 via a bus line 160. The CPU 110 functions as a central controller. The CPU 110 is connected to the RAM 120 and the ROM 130. The RAM 120 functions as a work area of the CPU 110. A boot program and the like are stored in the ROM 130. The CPU 110 can access a hard disk 140 via the bus line 160. Data and programs are stored in the hard disk 140. Examples of the data stored in the hard disk 140 are document data, graphic data, and image data, which can be designated as source data for printing. Examples of the programs stored in the hard disk 140 are a print application program and a printer driver program installed by reading thereof out of an information recording medium that is not illustrated in the drawing.

The printer driver program is a program for converting print data, which is generated on the basis of document data, image data, or the like, into intermediate image data, which can be processed by the printer 200. The print data is an example of liquid ejecting data. An example of the above is one that is made up of multilevel signals for each color component of cyan, magenta, yellow, and black. The print application program is a program that causes the CPU 110 to perform predetermined operation in order to, for example, acquire information necessary for printing and carry out computation in response to the operation of a user. That is, in accordance with the print application program, the CPU 110 performs operation such as the generation of print data for ejecting ink of a predetermined color from each of the plurality of nozzles N onto the medium 50. In addition, the CPU 110 communicates with the printer 200 via an interface unit 150.

On the other hand, the printer 200 includes a CPU 210, which functions as its central controller. The CPU 210 communicates with the computer 100 via an interface unit 270. The CPU 210 is connected to a RAM 220 and a ROM 230 via a bus line 280. The RAM 220 functions as a work area of the CPU 210. The print data received from the computer 100 is temporarily stored in the RAM 220. Programs are stored in the ROM 230. The CPU 210 performs predetermined operation on the basis of the programs to perform printing.

The CPU 210 of the printer 200 is connected to a transportation motor driving unit 240, a movement motor driving unit 250, and a head driving unit 260. Under the control of the CPU 210, the transportation motor driving unit 240 drives the paper-transport motor 241. The movement motor driving unit 250 and the head driving unit 260 drive the carriage motor 251 and the piezoelectric elements 261 respectively under the control of the CPU 210.

The head driving unit 260 drives the piezoelectric elements 261 in synchronization with the driving of the paper-transport motor 241 and the carriage motor 251. In monochrome printing and color printing, black ink is discharged from the discharging portion 44 and (the individual discharging portion 46*a* of) the group of discharging portions 46, which are in communication with the ink cartridge 34, and from the discharging portion 45 and (the individual discharging portion 46*b* of) the group of discharging portions 46, which are in communication with the ink cartridge 35. So-called flushing operation is performed at the time of replacement of the ink cartridges 34 and 35. In flushing, the carriage 20 is moved to an area that is away from the medium 50. Then, ink is discharged from the recording head 30 of the carriage 20. By this means, it is possible to make ink flow through the flow passages 34*b* and 35*b* uniformly. Since ink discharged during flushing does not contribute to printing, it is preferable to replace the ink cartridges 34 and 35 at the same time in order to increase the efficiency of use of ink. For this reason, it is necessary to ensure that the amount of ink contained in the ink cartridges 34 and 35 should decrease at the same speed.

Figure 5:
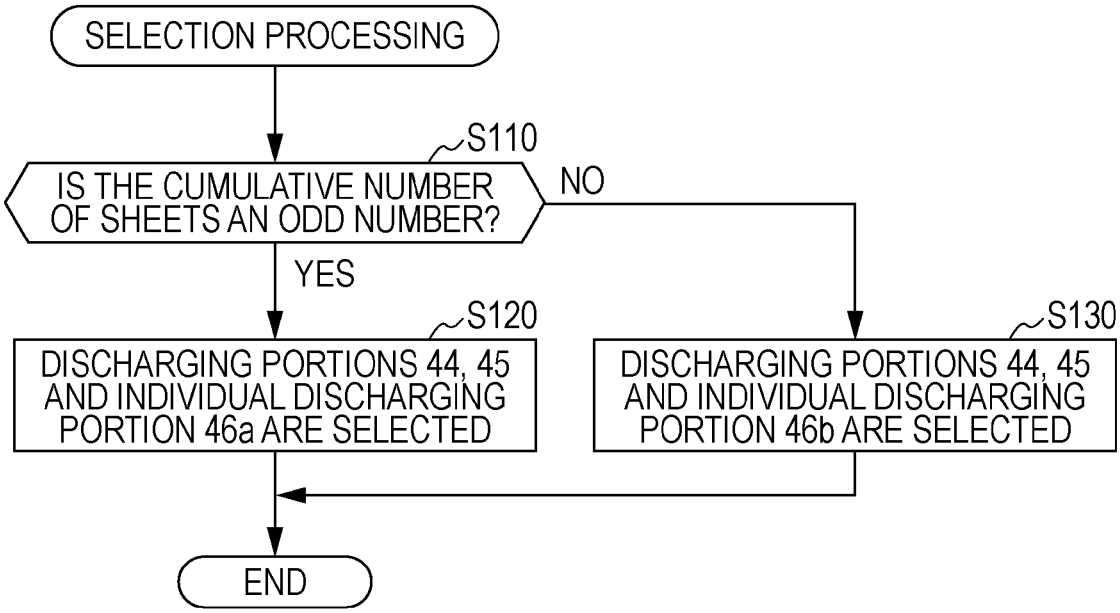
FIG. 5 is a flowchart that schematically illustrates nozzle line selection processing according to a first mode.

In view of the above, under the control of the CPU 210, the head driving unit 260 drives the piezoelectric elements 261 in such a manner that the relative ratio of the frequency of use of the discharging portion 44, the discharging portion 45, the individual discharging portion 46*a*, and the individual discharging portion 46*b* is 1:1:0.5:0.5. Specifically, there are the following three modes for the selection of a discharging portion that is to be used. FIG. 5 is a flowchart that schematically illustrates nozzle line selection processing according to a first mode, which is performed by the CPU 210. As a first step, the CPU 210 judges whether the cumulative number of sheets since power activation is an odd number or not (step S110).

If the cumulative number of sheets is an odd number, the process proceeds to a step S120. In the step S120, the CPU 210 selects the discharging portion 44, the discharging portion 45, and the individual discharging portion 46*a* and then drives the piezoelectric elements 261 corresponding to the nozzles aligned in the discharging portion 44, the discharging portion 45, and the individual discharging portion 46*a*. Let the average value of the amount of ink required for printing on a sheet of printing paper by one discharging portion be denoted as Q. Since the ink cartridge 34 is in communication with the discharging portion 44 and the individual discharging portion 46*a* through the flow passage 34*b*, in a case where the cumulative number of sheets is an odd number, the amount of ink contained in the ink cartridge 34 decreases by "2Q". On the other hand, in a case where the cumulative number of sheets is an odd number, the amount of ink contained in the ink cartridge 35 decreases by "Q". Let the frequency of use of the discharging portion 44, the discharging portion 45, the individual discharging portion 46*a*, and the individual discharging portion 46*b* be denoted as R1, R2, R3, and R4, respectively. The ratio of the frequency of use R1:R2:R3:R4 is 1:1:1:0 in the above case.

If the cumulative number of sheets is an even number, the process proceeds to a step S130. In the step S130, the CPU 210 selects the discharging portion 44, the discharging portion 45, and the individual discharging portion 46*b* and then drives the piezoelectric elements 261 corresponding to the nozzles aligned in the discharging portion 44, the discharging portion 45, and the individual discharging portion 46*b*. Since the ink cartridge 35 is in communication with the discharging portion 45 and the individual discharging portion 46*b* through the flow passage 35*b*, in a case where the cumulative number of sheets is an even number, the amount of ink contained in the ink cartridge 35 decreases by "2Q", whereas the amount of ink contained in the ink cartridge 34 decreases by "Q". The ratio of the frequency of use R1:R2:R3:R4 is 1:1:0:1 in a case where the cumulative number of sheets is an even number.

On average, the amount of ink contained in the ink cartridge 34 decreases by "1.5Q" each time when printing is performed on a sheet of paper. On average, the amount of ink contained in the ink cartridge 35 decreases by "1.5Q" each time when printing is performed on a sheet of paper. Therefore, ink contained in the ink cartridge 34 and ink contained in the ink cartridge 35 is consumed equally. Consequently, the need for the replacement of the ink cartridges 34 and 35 will arise at the same point in time. It follows that the average of the ratio of the frequency of use R1:R2:R3:R4 in a case where the cumulative number of sheets is an odd number and the ratio of the frequency of use R1:R2:R3:R4 in a case where the cumulative number of sheets is an even number is 1:1:0.5:0.5. In the above example, the individual discharging portion of the group of discharging portions 46 that is used for printing is switched from 46*a* to 46*b* or vice versa for every sheet. However, selection processing according to the first mode is not limited to the above example. The individual discharging portion of the group of discharging portions 46 that is used for printing may be switched for every set of sheets, the number of which has been predetermined.

Figure 6:
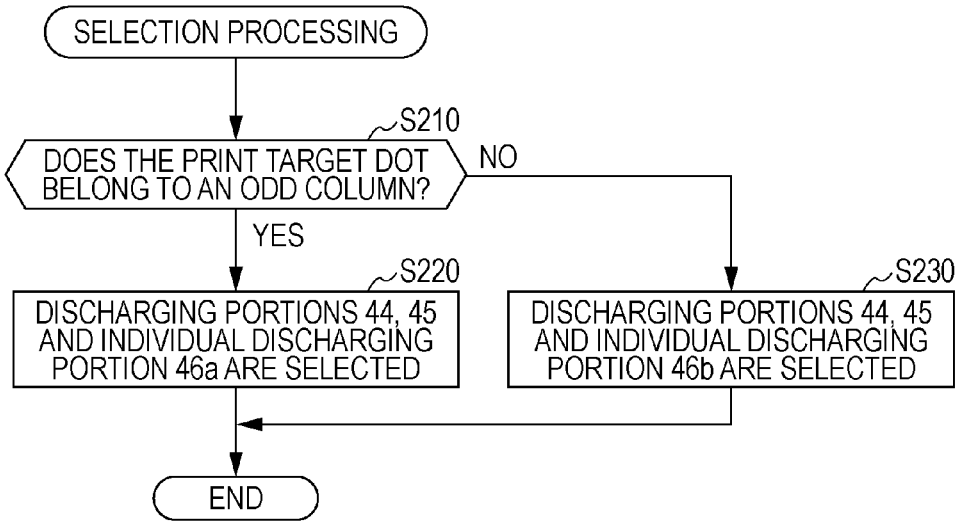
FIG. 6 is a flowchart that schematically illustrates nozzle line selection processing according to a second mode.

FIG. 6 is a flowchart that schematically illustrates nozzle line selection processing according to a second mode, which is performed by the CPU 210. As a first step, the CPU 210 judges whether a print target dot belongs to an odd column or not (step S210). If the print target dot belongs to an odd column, the process proceeds to a step S220. In the step S220, the CPU 210 selects the discharging portion 44, the discharging portion 45, and the individual discharging portion 46*a* and then drives the piezoelectric elements 261 corresponding to the nozzles aligned in the discharging portion 44, the discharging portion 45, and the individual discharging portion 46*a*. In a case where the print target dot belongs to an odd column, the ratio of the frequency of use of the discharging portion 44, the discharging portion 45, the individual discharging portion 46*a*, and the individual discharging portion 46*b*, which is denoted as R1:R2:R3:R4, is 1:1:1:0. If the print target dot belongs to an even column, the process proceeds to a step S230. In the step S230, the CPU 210 selects the discharging portion 44, the discharging portion 45, and the individual discharging portion 46*b* and then drives the piezoelectric elements 261 corresponding to the nozzles aligned in the discharging portion 44, the discharging portion 45, and the individual discharging portion 46*b*. In a case where the print target dot belongs to an even column, the ratio of the frequency of use of the discharging portion 44, the discharging portion 45, the individual discharging portion 46*a*, and the individual discharging portion 46*b*, R1:R2:R3:R4, is 1:1:0:1. It follows that the average of the ratio of the frequency of use R1:R2:R3:R4 in a case where the print target dot belongs to an odd column and the ratio of the frequency of use R1:R2:R3:R4 in a case where the print target dot belongs to an even column is 1:1:0.5:0.5. Since the ink cartridge 34 is in communication with the discharging portion 44 and the individual discharging portion 46*a* through the flow passage 34*b*, the amount of ink consumed per unit time is proportional to the sum of the frequency of use of the discharging portion 44 and the frequency of use of the individual discharging portion 46*a*, that is, "1.5". On the other hand, since the ink cartridge 35 is in communication with the discharging portion 45 and the individual discharging portion 46*b* through the flow passage 35*b*, the amount of ink consumed per unit time is proportional to the sum of the frequency of use of the discharging portion 45 and the frequency of use of the individual discharging portion 46*b*, that is, "1.5". Therefore, ink contained in the ink cartridge 34 and ink contained in the ink cartridge 35 is consumed equally. Consequently, the need for the replacement of the ink cartridges 34 and 35 will arise at the same point in time. In the above example, the individual discharging portion of the group of discharging portions 46 that is used for printing is switched from 46*a* to 46*b* or vice versa for every column. However, selection processing according to the second mode is not limited to the above example. The individual discharging portion of the group of discharging portions 46 that is used for printing may be switched for every set of columns, the number of which has been predetermined.

Figure 7:
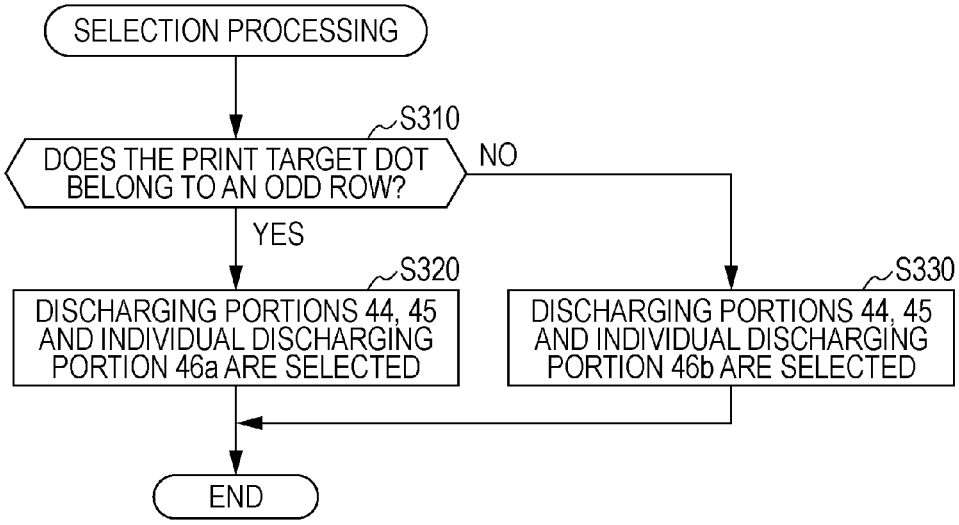
FIG. 7 is a flowchart that schematically illustrates nozzle line selection processing according to a third mode.

FIG. 7 is a flowchart that schematically illustrates nozzle line selection processing according to a third mode, which is performed by the CPU 210. As a first step, the CPU 310 judges whether a print target dot belongs to an odd row or not (step S310). If the print target dot belongs to an odd row, the process proceeds to a step S320. In the step S320, the CPU 210 selects the discharging portion 44, the discharging portion 45, and the individual discharging portion 46*a* and then drives the piezoelectric elements 261 corresponding to the nozzles aligned in the discharging portion 44, the discharging portion 45, and the individual discharging portion 46*a*. In a case where the print target dot belongs to an odd row, the ratio of the frequency of use of the discharging portion 44, the discharging portion 45, the individual discharging portion 46*a*, and the individual discharging portion 46*b*, which is denoted as R1:R2:R3:R4, is 1:1:1:0. If the print target dot belongs to an even row, the process proceeds to a step S330. In the step S330, the CPU 210 selects the discharging portion 44, the discharging portion 45, and the individual discharging portion 46*b* and then drives the piezoelectric elements 261 corresponding to the nozzles aligned in the discharging portion 44, the discharging portion 45, and the individual discharging portion 46*b*. In a case where the print target dot belongs to an even row, the ratio of the frequency of use of the discharging portion 44, the discharging portion 45, the individual discharging portion 46*a*, and the individual discharging portion 46*b*, R1:R2:R3:R4, is 1:1:0:1. It follows that the average of the ratio of the frequency of use R1:R2:R3:R4 in a case where the print target dot belongs to an odd row and the ratio of the frequency of use R1:R2:R3:R4 in a case where the print target dot belongs to an even row is 1:1:0.5:0.5. Since the ink cartridge 34 is in communication with the discharging portion 44 and the individual discharging portion 46*a* through the flow passage 34*b*, the amount of ink consumed per unit time is proportional to the sum of the frequency of use of the discharging portion 44 and the frequency of use of the individual discharging portion 46*a*, that is, "1.5". On the other hand, since the ink cartridge 35 is in communication with the discharging portion 45 and the individual discharging portion 46*b* through the flow passage 35*b*, the amount of ink consumed per unit time is proportional to the sum of the frequency of use of the discharging portion 45 and the frequency of use of the individual discharging portion 46*b*, that is, "1.5". Therefore, ink contained in the ink cartridge 34 and ink contained in the ink cartridge 35 is consumed equally. Consequently, the need for the replacement of the ink cartridges 34 and 35 will arise at the same point in time. In the above example, the individual discharging portion of the group of discharging portions 46 that is used for printing is switched from 46*a* to 46*b* or vice versa for every row. However, selection processing according to the third mode is not limited to the above example. The individual discharging portion of the group of discharging portions 46 that is used for printing may be switched for every set of rows, the number of which has been predetermined. With the above switching between the individual discharging portions 46*a* and 46*b* for every unit time period determined by, for example, a predetermined number of sheets, a predetermined number of columns, or a predetermined number of rows, it is possible to perform nozzle line selection processing according to the present embodiment of the invention.

As described above, when more than one ink cartridge of the same color is used, the present embodiment of the invention makes it possible to ensure that ink contained in these ink cartridges runs out at substantially the same point in time. For this reason, a user can replace the ink cartridges at a time. The reduced number of times of replacement required is friendly to users in terms of laborsaving. In addition, since the number of times of replacement required is reduced, the number of times of flushing operation that has to be performed after the completion of replacement of the ink cartridge that needs to be replaced can also be reduced. This means that the total amount of ink ejected due to flushing can be reduced, which results in a reduction in the amount of consumption of ink contained in each of the ink cartridges 31 to 35.

2. Variation Examples

The present invention is not limited to the exemplary embodiment described above. The invention can be modified in a variety of ways, several examples of which are described below.

Figure 8:
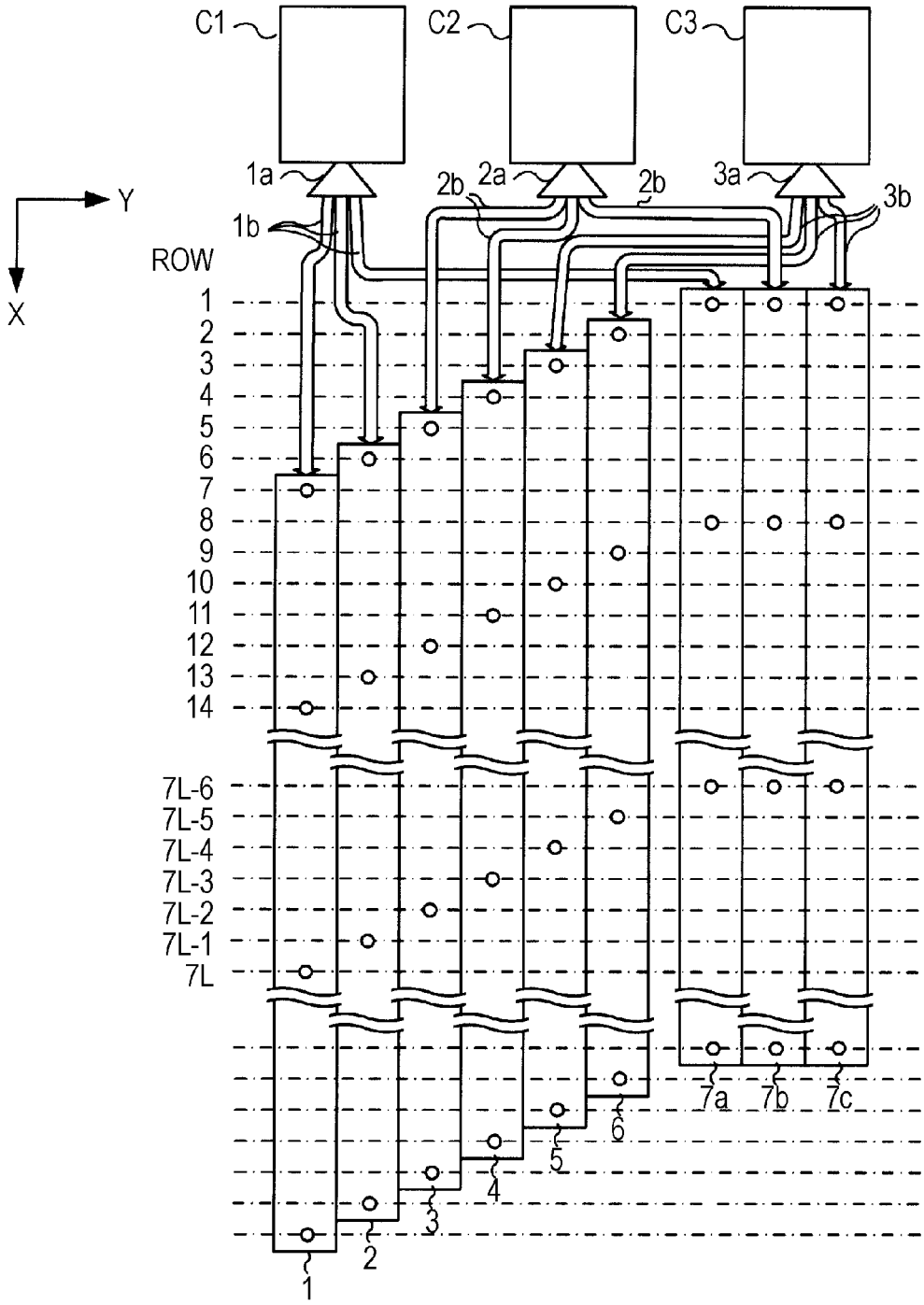
FIG. 8 is a diagram that schematically illustrates a relationship between ink cartridges, discharging portions, and individual discharging portions according to a variation example of the invention.

(1) In the foregoing embodiment of the invention, it is explained that each of the ink cartridges 34 and 35 contains black ink as an example of liquid of the same kind. The black ink is supplied from these ink cartridges to four discharging portions (i.e., the discharging portion 44, the discharging portion 45, the individual discharging portion 46*a*, and the individual discharging portion 46*b*) through the flow passages 34*b* and 35*b*, each of which includes two branches. However, the scope of the invention is not limited to such an exemplary structure. As a variation example, it is assumed here that a modified system includes three ink cartridges C1, C2, and C3, six discharging portions 1 to 6, and a group of discharging portions 7 as illustrated in FIG. 8. The group of discharging portions 7 is made up of three individual discharging portions 7*a*, 7*b*, and 7*c*. A flow passage 1*b* branches from a needle 1*a*, which corresponds to the ink cartridge C1, into three branch passages. Each of the branch passages corresponds to one of the discharging portions 1 and 2 and the individual discharging portion 7*a*. The ink cartridge C1 is in communication with the discharging portions 1 and 2 and the individual discharging portion 7*a* through the three branch passages. A flow passage 2*b* branches from a needle 2*a*, which corresponds to the ink cartridge C2, into three branch passages. Each of the branch passages corresponds to one of the discharging portions 3 and 4 and the individual discharging portion 7*b*. The ink cartridge C2 is in communication with the discharging portions 3 and 4 and the individual discharging portion 7*b* through the three branch passages. A flow passage 3*b* branches from a needle 3*a*, which corresponds to the ink cartridge C3, into three branch passages. Each of the branch passages corresponds to one of the discharging portions 5 and 6 and the individual discharging portion 7*c*. The ink cartridge C3 is in communication with the discharging portions 5 and 6 and the individual discharging portion 7*c* through the three branch passages.

Let the frequency of use of the discharging portions 1 to 6 and the individual discharging portions 7*a*, 7*b*, and 7*c* be denoted as R1, R2, R3, R4, R5, R6, R7, R8, and R9, respectively. It is possible to produce the above advantageous effects by setting the ratio of the frequency of use thereof, which is denoted as R1:R2:R3:R4:R5:R6:R7:R8:R9, as 1:1:1:1:1:1:1:1/3:1/3:1/3. The specific features of the exemplary concept of the invention can be generalized as follows. Let the number of ink cartridges of the same color be denoted as P (where P is a natural number that is not less than 2). Let the number of discharging portions each of which (or one of which) has nozzles (N) that are located at positions in the sub scan direction (X) that are different from the positions of the nozzles N of the other discharging portions (or the other discharging portion) in the sub scan direction X (and from the positions of the nozzles N of a group of discharging portions mentioned below in the sub scan direction X) be denoted as P×J (where J is a natural number). Let the number of individual discharging portions that make up a group of discharging portions be denoted as P×K (where K is a natural number). Let the frequency of use of each of the P×J discharging portions be denoted as Ra. Let the frequency of use of each of the P×K individual discharging portions be denoted as Rb. For each of the P ink cartridges, a flow passage that branches from the ink cartridge to the J discharging portion(s) and the K individual discharging portion(s) is provided.

Since the nozzles N of each of the discharging segments, which are made up of the P×J discharging portions and the single group of discharging portions, are shifted from those of the others in the sub scan direction X, each of the discharging segments is used for printing for one set of rows. Therefore, the frequency of use of each of the P×J discharging portions is equal to the frequency of use of the single group of discharging portions. In addition, the P×K individual discharging portions that make up the group of discharging portions have equal frequency of use. Therefore, when the frequency of use of the discharging portion is denoted as "1", the frequency of use of the individual discharging portion is denoted as "1/(P×K)". Therefore, the ratio of Ra to Rb, Ra:Rb, is 1:1/(P×K). In the above variation example, the values of P, J, and K are: P=3, J=2, and K=1. In the foregoing embodiment of the invention, the values of P, J, and K are: P=2, J=1, and K=1.

(2) Though it is explained in the foregoing embodiment of the invention that the CPU 210 of the ink-jet printer 200 controls the frequency of use of each of the discharging portion 44, the discharging portion 45, the individual discharging portion 46*a*, and the individual discharging portion 46*b*, the CPU 110 of the computer 100 may carry out such frequency-of-use control in place of the CPU 210 by executing the printer driver program.

(3) In the foregoing embodiment of the invention, it is explained that one ink cartridge is used for each of cyan, magenta, and yellow, whereas the number of ink cartridges used for black is two. However, the scope of the invention is not limited to such an example. For example, a plurality of ink cartridges may be provided for each of, or any of, cyan, magenta, and yellow. As with the reduction in the number of times of black-cartridge replacement explained in the foregoing embodiment of the invention, it is possible to reduce the number of times of cartridge replacement by adjusting the frequency of use for equalized (i.e., averaged) ink ejection.

(4) The printer 200, which ejects ink, is taken as an example of a liquid ejecting apparatus in the foregoing embodiment of the invention. However, the scope of the invention is not limited to such an example. The invention can be applied to various kinds of liquid ejecting apparatuses that eject liquid in the form of droplets. Examples of various liquid ejecting apparatuses are: a printing apparatus including but not limited to a fax machine and a copier, an apparatus that ejects liquid in which, for example, a material such as an electrode material, a color material, or the like that is used in the production of a liquid crystal display device, an organic EL (electroluminescence) display device, a surface/plane emission display device, or the like is dispersed or dissolved, an apparatus that ejects a living organic material that is used in the production of biochips, an apparatus that is used as a high precision pipette and ejects sample liquid, and the like. Besides the above apparatuses, the invention can be applied to a valve apparatus used for an apparatus other than a liquid ejecting apparatus.

What is claimed is:

1. A liquid ejecting apparatus that ejects liquid supplied from a first container and a second container to form dots on a printing target, the second container containing a same liquid as that of the first container, the liquid ejecting apparatus comprising:

a liquid ejecting head provided with a first group of nozzles and a second group of nozzles, the first group ejecting the liquid from the first container through a first flow passage, the second group ejecting the liquid from the second container through a second flow passage that does not communicate with the first flow passage; and a controller adapted to control ejection by the first and second group during scans between the liquid ejecting head and the printing target; wherein each of the first and second group has an individual nozzle and an overlap nozzle, the overlap nozzles overlapping each other in a direction of the scan between the first and second groups, the individual nozzles not overlapping each other in the direction of the scan between the first and second groups, and the controller selectively uses the overlap nozzles of the first and second groups to form a dot during one scan.

2. The liquid ejecting apparatus according to claim 1, wherein each of the group forms dots in line orthogonal to the scan.

3. The liquid ejecting apparatus according to claim 1, wherein each of the first and second containers is replaceable respectively.

4. The liquid ejecting apparatus according to claim 1, wherein each of the first and second containers is replaceable at a time.

5. The liquid ejecting apparatus according to claim 1, wherein usage amounts of the liquid of the first and second containers are adjustable.

6. The liquid ejecting apparatus according to claim 1, wherein flushing operation is performed after replacement of at least the first and second containers is completed.

7. The liquid ejecting apparatus according to claim 2, wherein each of the first and second containers is replaceable respectively.

8. The liquid ejecting apparatus according to claim 2, wherein each of the first and second containers is replaceable at a time.

9. The liquid ejecting apparatus according to claim 3, wherein each of the first and second containers is replaceable at a time.

10. The liquid ejecting apparatus according to claim 2, wherein usage amounts of the liquid of the first and second containers are adjustable.

11. The liquid ejecting apparatus according to claim 3, wherein usage amounts of the liquid of the first and second containers are adjustable.

12. The liquid ejecting apparatus according to claim 4, wherein usage amounts of the liquid of the first and second containers are adjustable.

13. The liquid ejecting apparatus according to claim 2, wherein a flushing operation is performed after replacement of at least the first and second containers is completed.

14. The liquid ejecting apparatus according to claim 3, wherein a flushing operation is performed after replacement of at least the first and second containers is completed.

15. The liquid ejecting apparatus according to claim 4, wherein a flushing operation is performed after replacement of at least the first and second containers is completed.

16. The liquid ejecting apparatus according to claim 5, wherein a flushing operation is performed after replacement of at least the first and second containers is completed.

* * * * *